US010580631B2

(12) United States Patent
Hosoi

(10) Patent No.: US 10,580,631 B2
(45) Date of Patent: Mar. 3, 2020

(54) ANALYTICAL DEVICE

(71) Applicant: SHIMADZU CORPORATION, Kyoto-shi, Kyoto (JP)

(72) Inventor: Kosuke Hosoi, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 15/996,643

(22) Filed: Jun. 4, 2018

(65) Prior Publication Data

US 2018/0374691 A1 Dec. 27, 2018

(30) Foreign Application Priority Data

Jun. 23, 2017 (JP) ..... 2017-123232

(51) Int. Cl.

| | |
|---|---|
| ***H01J 49/00*** | (2006.01) |
| ***H01J 49/26*** | (2006.01) |
| ***H01J 49/02*** | (2006.01) |
| ***H01J 49/04*** | (2006.01) |

(52) U.S. Cl.

CPC ..... *H01J 49/0022* (2013.01); *H01J 49/0013* (2013.01); *H01J 49/02* (2013.01); *H01J 49/0422* (2013.01); *H01J 49/26* (2013.01)

(58) Field of Classification Search

CPC .... H01J 49/0022; H01J 49/0013; H01J 49/02; H01J 49/0422; H01J 49/26

USPC ..... 250/281, 282, 288

See application file for complete search history.

(56) References Cited

U.S. PATENT DOCUMENTS

| | | | | |
|---|---|---|---|---|
| 4,640,677 | A * | 2/1987 | Huber | B01F 3/026 137/112 |
| 5,313,061 | A | 5/1994 | Drew et al. | |
| 2011/0088256 | A1 | 4/2011 | Sasajima et al. | |
| 2017/0266887 | A1 * | 9/2017 | Roviaro | B33Y 10/00 |

OTHER PUBLICATIONS

Communication dated Nov. 19, 2018, from European Patent Office in counterpart application No. 18176530.6.

Communication dated Feb. 25, 2019 from the European Patent Office in application No. 18176530.6.

A Website of Nippon Tansan Gas Co., Ltd. Illustrating Its Mini Gas Cylinders in English, Printed on May 9, 2018, http://www.ntg.co.jp/english/products/.

A Website of Nippon Tansan Gas Co., Ltd. Illustrating Its Mini Regulators in English, Printed on May 9, 2018, http://www.ntg.co.jp/english/products/regulators.php.

A Website of Perkinelmer, Inc. Illustrating Its GC/MS, Printed on Apr. 14, 2017, http://torion.com/products/torion.html.

An Online Catalog Published by Perkinelmer, Inc. Illustrating Its GC/MS, www.perkinelmer.com/torion.

A Website of Nippon Tansan Gas Co., Ltd. Illustrating Its Mini Gas Cylinders in Japanese, Printed on Apr. 14, 2017, http://www.ntg.co.jp/products/minigas.php.

A Website of Nippon Tansan Gas Co., Ltd. Illustrating Its Regulators in Japanese, Printed on Apr. 14, 2017, http://www.ntg.co.jp/products/regiilators.php.

* cited by examiner

*Primary Examiner* — Nicole M Ippolito

(74) *Attorney, Agent, or Firm* — Sughrue Mion, PLLC

(57) ABSTRACT

An analytical device includes: a regulator to which a gas storage container attached and which is held by a holder; a gas introduction chamber to which gas in the gas storage container is supplied through the regulator; and a movement mechanism that moves the holder so that the regulator moves between a measurement position and a non-measurement position.

17 Claims, 5 Drawing Sheets

ANALYTICAL DEVICE

INCORPORATION BY REFERENCE

The disclosure of the following application is herein incorporated by reference: Japanese Patent Application No. 2017-123232 filed Jun. 23, 2017.

BACKGROUND OF THE INVENTION

1. Field of the Invention

The present invention relates to an analytical device having a gas storage container attached thereto and detached therefrom.

2. Description of Related Art

Conventional analytical devices such as mass spectrometry devices are supplied with gas required for analysis from a gas cylinder installed separately from the analytical device, through a gas supply conduit. The demand for portable mass spectrometry devices has recently been increasing and analytical devices having built-in gas storage containers are also known, such as a gas chromatograph mass spectrometer disclosed in U.S. Pat. No. 5,313,061.

SUMMARY OF THE INVENTION

However, in the analytical device described in U.S. Pat. No. 5,316,061, a task of attaching and detaching a gas storage container within the device is required during replacement of the gas storage container. It is thus desired to improve task efficiency. The improvement in task efficiency of attaching and detaching gas storage containers is desired not only for chromatographs and mass spectrometry devices, but also for variety of types of analytical devices.

According to the 1st aspect of the present invention, an analytical device comprises a regulator to which a gas storage container attached and which is held by a holder; a gas introduction chamber to which gas in the gas storage container is supplied through the regulator; and a movement mechanism that moves the holder so that the regulator moves between a measurement position and a non-measurement position.

According to the 2nd aspect of the present invention, in the analytical device according to the 1st aspect, it is preferred that the measurement position is a position of a regulator in which the gas storage container is located inside the analytical device; and the non-measurement position is a position of a regulator in which at least a part of the gas storage container or the entire gas storage container is exposed to an outside of the analytical device.

According to the 3rd aspect of the present invention, in the analytical device according to the 1st aspect, it is preferred that the measurement position is a position in which the regulator is located close to a surface of a housing of the analytical device; and the non-measurement position is a position in which at least one end of the gas storage container is located further away from the surface of the housing, compared with when the regulator is positioned at the measurement position.

According to the 4th aspect of the present invention, in the analytical device according to any one of the 1st through 3rd aspects, it is preferred that the movement mechanism comprises a guide rail that holds the holder so that the holder can move between the measurement position and the non-measurement position.

According to the 5th aspect of the present invention, in the analytical device according to the 4th aspect, it is preferred that the guide rail holds the holder so that the holder can linearly move between the measurement position and the non-measurement position.

According to the 6th aspect of the present invention, in the analytical device according to any one of the 1st through 3rd aspects, it is preferred that the movement mechanism comprises a hinge mechanism that holds the holder so that the holder can pivot between the measurement position and the non-measurement position.

According to the 7th aspect of the present invention, in the analytical device according to any one of the 1st through 3rd aspects, it is preferred that the movement mechanism comprises a guide rail and a hinge mechanism; and the movement of the hinge mechanism held by the guide rail and the pivot movement of the holder held by the hinge mechanism allow the regulator to move between the measurement position and the non-measurement position.

According to the 8th aspect of the present invention, it is preferred that the analytical device according to any one of the 1st through 7th aspects comprises a plurality of regulators to which a plurality of gas storage containers are respectively attached and which are respectively held by the plurality of holders, wherein: the movement mechanism individually moves the plurality of holders.

According to the 9th aspect of the present invention, it is preferred that the analytical device according to any one of the 1st through 8th aspects comprises a mass spectrometer, wherein: the gas introduction chamber includes comprises an electrode that controls ions.

BRIEF DESCRIPTION OF THE DRAWINGS

FIG. 2A illustrates a case where regulators are positioned at a measurement position and FIG. 2B illustrates a case where a regulator is positioned at a non-measurement position.

FIG. 4A illustrates a case where regulators are positioned at a measurement position and FIG. 4B illustrates a case where the regulators are positioned at a non-measurement position.

FIG. 5A illustrates a case where the regulators are positioned at the measurement position and FIG. 5B illustrates a case where the regulators are positioned at the non-measurement position.

DESCRIPTION OF EMBODIMENTS

First Embodiment

Figure 1:
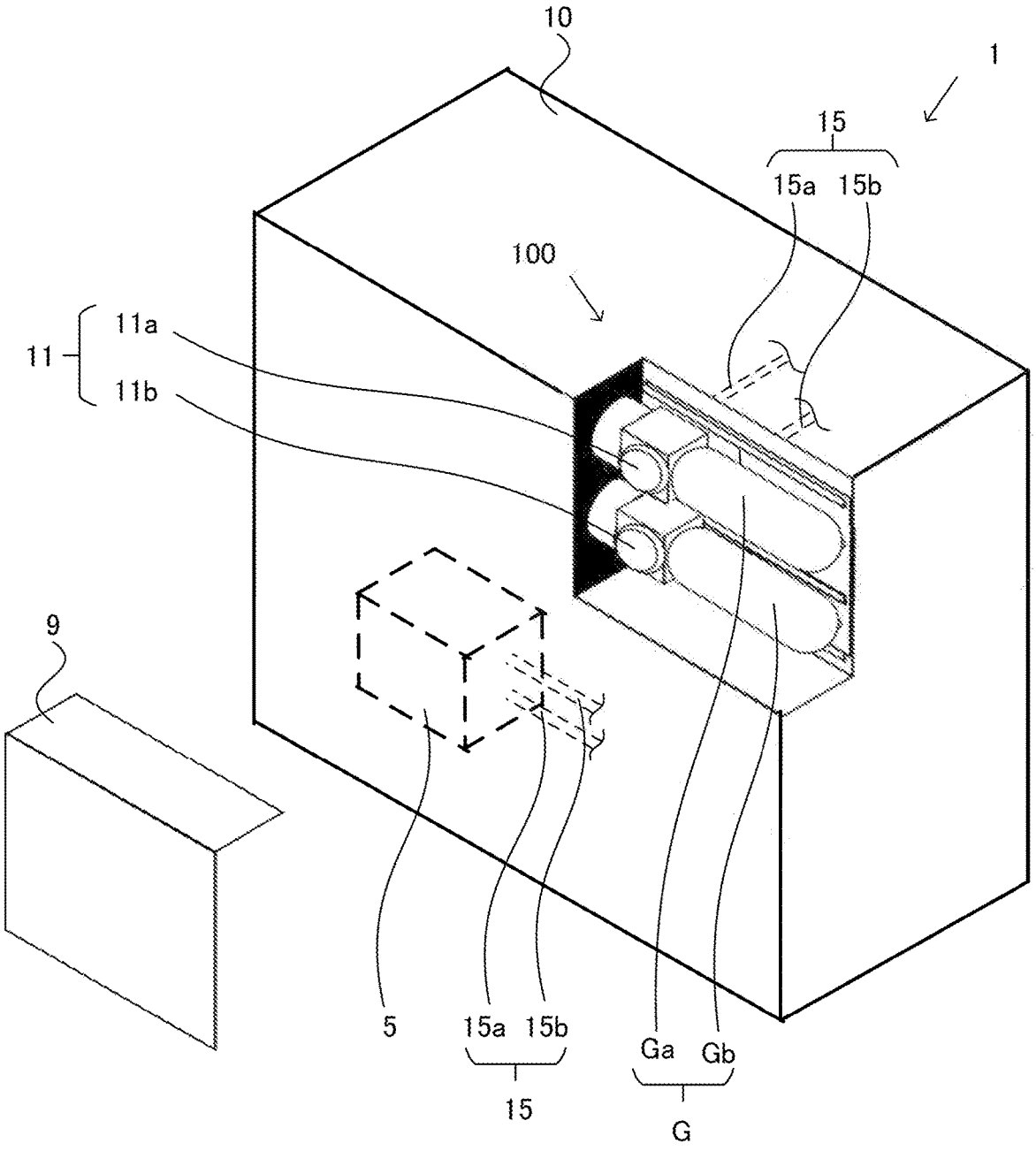
FIG. 1 is a perspective view illustrating a schematic configuration of a mass spectrometry device according to a first embodiment.
Figure 2A:
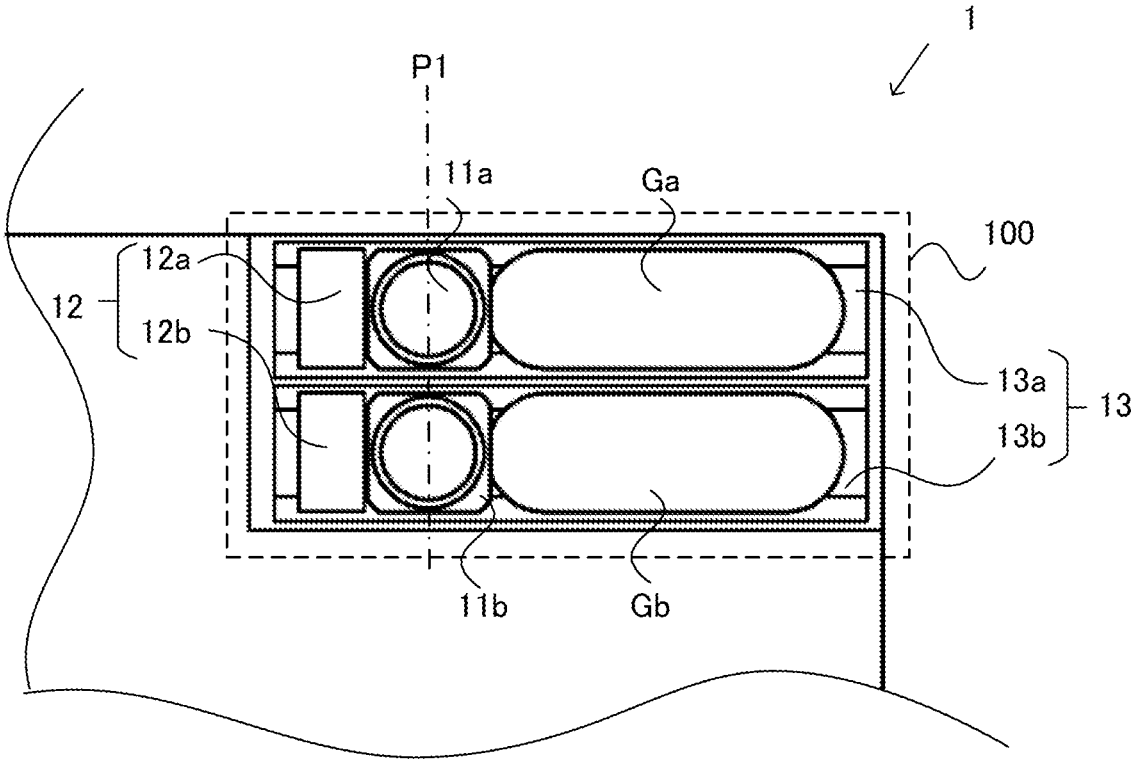
FIGS. 2A and 2B are front views illustrating a storing unit of the mass spectrometry device in FIG. 1.
Figure 2B:
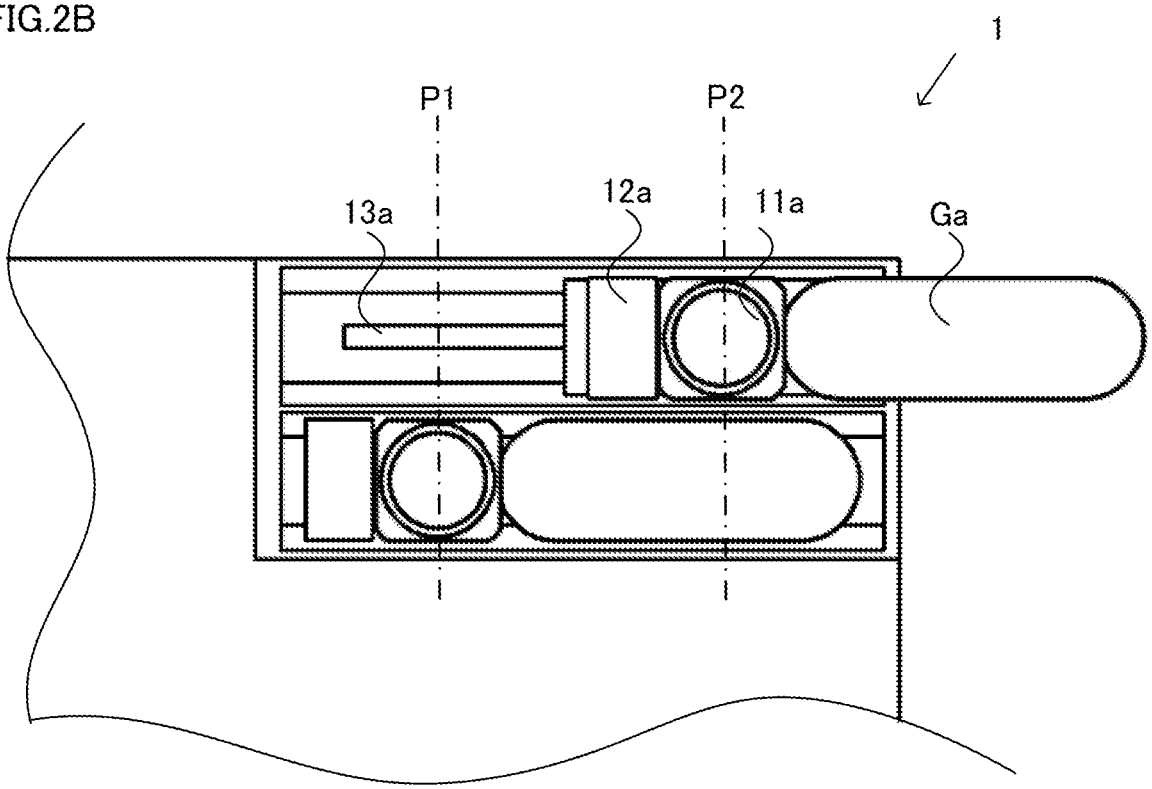
Figure 3:
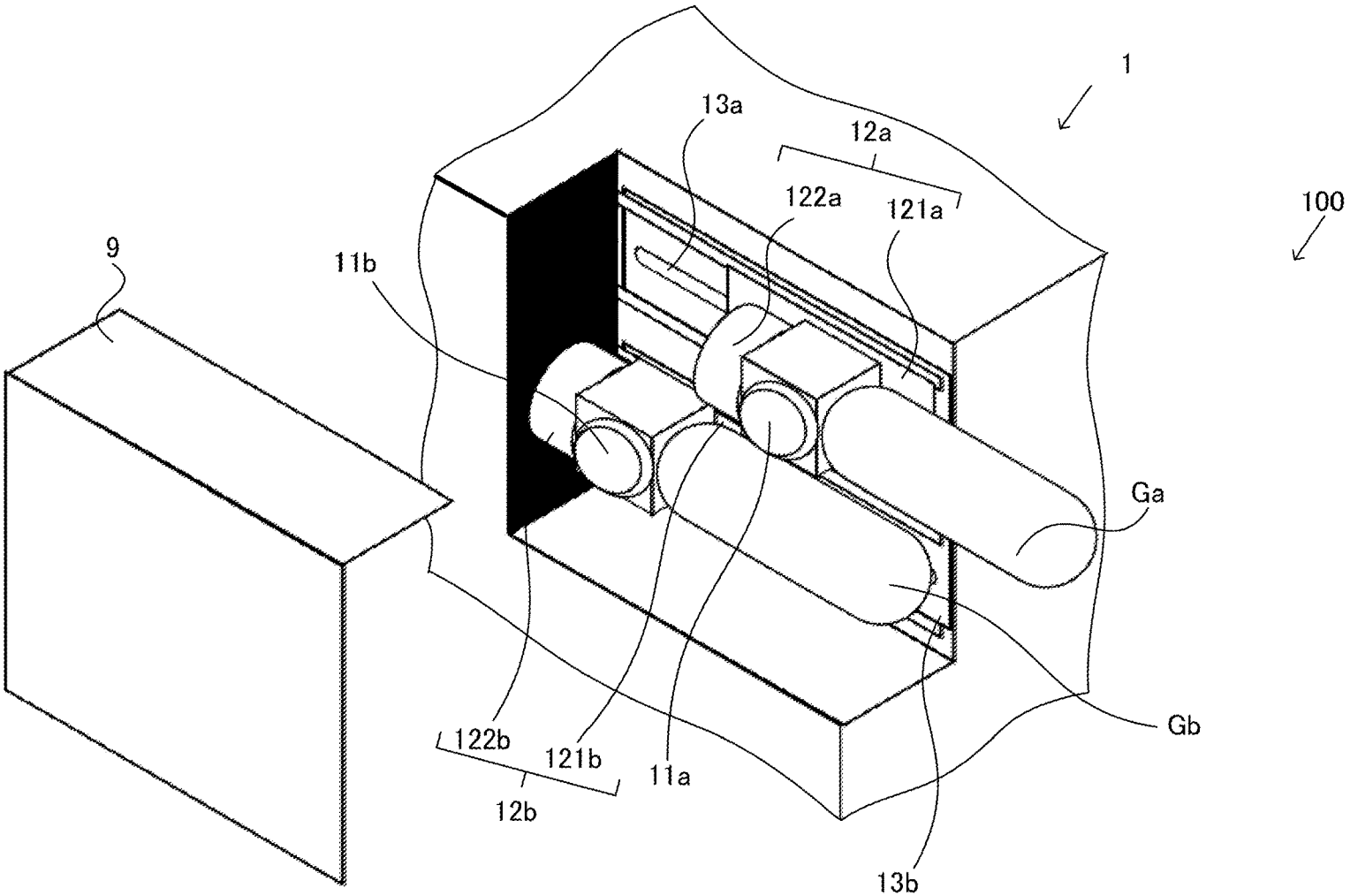
FIG. 3 is a perspective view illustrating a schematic configuration of a storing unit in the case where the regulator illustrated in FIG. 2B is positioned at a non-measurement position.

A first embodiment will be described with reference to FIGS. 1, 2A, 2B, and 3. FIG. 1 is a view illustrating a schematic configuration of a mass spectrometry device 1 according to the first embodiment. FIGS. 2A and 2B are front views of a relevant part, illustrating a storing unit of the mass spectrometry device 1. FIG. 3 is a perspective view of the storing unit. The mass spectrometry device is referred to as one of analytical devices (analyzers).

The mass spectrometry device 1 includes a main body 10 incorporating a mass spectrometer, and a cover 9. The main body 10 includes a storing unit 100 including regulators 11*a*, 11*b* for gas storage containers G, a gas introduction chamber 5, gas supply lines 15*a*, 15*b* for supplying gas from the regulators 11*a*, 11*b* to the gas introduction chamber 5. The cover 9 is detachably arranged at a position where it covers the storing unit 100.

Gases stored in the gas storage containers Ga, Gb are flow-controlled by the regulators 11*a*, 11*b* and supplied to the gas introduction chamber 5 through the gas supply lines 15*a*, 15*b*. For an ion trap mass spectrometry device 1, the gas introduction chamber 5 is provided with an electrode that controls ions within the gas introduction chamber 5 and helium gas or argon gas is introduced into the gas introduction chamber 5. An ionized sample is trapped in the gas introduction chamber 5. The gas introduction chamber 5 is thus an ion trap.

In the example of the mass spectrometry device 1 illustrated in FIG. 1, the storing unit 100 includes two regulators 11*a*, 11*b* to which two gas storage containers Ga, Gb are respectively attached, holders 12*a*, 12*b* (see FIGS. 2A and 2B) that hold regulators 11*a*, 11*b*, and movement mechanisms 13*a*, 13*b* (see FIGS. 2A and 2B) which enable the holders 12*a* and 12*b* to move. For the ion trap mass spectrometry device 1, for example, different gases such as helium and argon are supplied from the two gas storage containers G to the gas introduction chamber 5. The types of gases can be selected as appropriate.

It should be noted that the number of the regulators 11*a*, 11*b* of the storing unit 100, i.e., the number of the gas storage containers Ga, Gb is not limited to a particular value. One regulator or three or more regulators may be used.

As described above, the storing unit 100 of the mass spectrometry device 1 according to the present embodiment includes movement mechanisms 13*a*, 13*b* that moves the regulators 11*a*, 11*b* and thus the holders 12*a*, 12*b*, which will be described later with reference to FIG. 3, to make attachment and detachment of the gas storage containers Ga, Gb easier at the time of replacement of the gas storage containers Ga, Gb, for example. The regulators 11*a*, 11*b* can move between a measurement position P1 and a non-measurement position P2 described below by the movement mechanisms 13*a* and 13*b*.

The measurement position P1 is a position of the regulators 11*a*, 11*b* in which the gases stored in the gas storage containers Ga, Gb are supplied to the gas introduction chamber 5 and measurements for analysis and the like are performed. The non-measurement position P2 is a position to which the regulators 11*a*, 11*b* move for attachment and detachment of the gas storage containers Ga, Gb.

FIG. 2A is a front view illustrating a schematic configuration of the storing unit 100 in the case where the regulators 11*a*, 11*b* are positioned at the measurement position P1. The storing unit 100 is configured to include guide rails 13*a*, 13*b*. The regulators 11*a*, 11*b*, to which the gas storage containers Ga, Gb are respectively attached, are held by the regulator holding units 12*a* and 12*b*. The regulator holders 12*a*, 12*b* are movably provided on the guide rails 13*a*, 13*b*. In the present embodiment, the guide rails 13*a* and 13*b* constitute a movement mechanism. This movement mechanism is designated by reference numeral 13.

The regulator holders 12*a*, 12*b* are guided by and moved on the guide rails 13*a*, 13*b* so that the regulators 11*a*, 11*b* move between the measurement position P1 and the non-measurement position P2. The guide rails 13*a*, 13*b* are arranged for the regulators 11*a*, 11*b*, respectively, and the two regulator holders 12*a*, 12*b* are individually movable along their corresponding guide rails 13*a*, 13*b*, respectively.

The holders 12*a*, 12*b* will be described in detail with reference to FIG. 3. FIG. 3 is a perspective view illustrating the storing unit 100 in the case where the regulator 11*a* is positioned at the non-measurement position P2. As illustrated in FIG. 3, the holders 12*a*, 12*b* include movable plate-like slide boards 121*a*, 121*b* respectively coupled to the guide rails 13*a*, 13*b*, and bases 122*a*, 122*b* respectively holding the regulators 11*a*, 11*b*. The holders 12*a*, 12*b* are moved on the guide rails 13*a*, 13*b* by the slide boards 121*a*, 121*b* moving along the guide rails 13*a* and 13*b*, respectively.

It should be noted that the holders 12*a*, 12*b* are not particularly limited to the structure in the embodiment as long as they are configured to hold the regulators 11*a*, 11*b* and to be guided and moved by the guide rails 13*a*, 13*b*.

As described above, the regulator holders 12*a*, 12*b* hold the regulators 11*a*, 11*b*, respectively. The regulator holders 12*a*, 12*b* are arranged to be movable on the guide rails 13*a*, 13*b*, respectively. The guide rails 13*a*, 13*b* are arranged in parallel to each other in a top view and hold the regulator holders 12*a*, 12*b* so that the regulator holders 12*a*, 12*b* can move linearly. A gas introduction port (not illustrated in the figure) is provided in an end face of each of the regulators 11*a*, 11*b* on the non-measurement position P2 side, and an internally threaded part for attaching the gas storage container is formed in the gas introduction port. Each of the gas storage containers Ga, Gb is screwed and attached into the internally threaded part of the corresponding gas introduction port in the same direction as a direction in which the gas storage containers Ga, Gb moves to the measurement position. The gas storage containers Ga, Gb are elongated cylinders having axial centers that coincide with directions in which the guide rails 13*a*, 13*b* extend.

It should be noted that the configuration of the guide rails 13*a*, 13*b* and the manner of movement of the regulators 11*a*, 11*b* are not limited to particular configurations or manners, and the guide rails 13*a*, 13*b* may be arranged along any curves. The axial centers of the gas storage containers Ga, Gb thus do not necessarily coincide with the directions in which the guide rails 13*a*, 13*b* extend.

FIG. 2B is a front view illustrating a schematic configuration of the storing unit 100 in the case where the regulator 11*a* is positioned at the non-measurement position P2. FIG. 2B illustrates a state after the user moves the regulator 11*a*, the regulator holder 12*a*, and the gas storage container Ga along the guide rail 13*a* so that the regulator 11*a* is moved to the non-measurement position P2, from the state in FIG. 2A in which the regulator 11*a* is positioned at the measurement position P1.

It should be noted that the regulator 11 may be moved manually or automatically.

Although the cover 9 is omitted in FIG. 2A, the cover 9 covers the storing unit 100 to analyze samples in the mass spectrometry device 1. When the regulator 11*a* is positioned at the measurement position P1, the gas storage container Ga is located inside the mass spectrometry device 1, i.e., inside the cover 9. In other words, when the regulator 11 is positioned at the measurement position P1, the gas storage container Ga is not exposed to the outside of the mass spectrometry device 1.

For replacement of the gas storage container Ga, the cover 9 is removed and the regulator 11*a* is moved to the non-measurement position P2 as illustrated in FIG. 2B. At this time, at least a part of the gas storage container Ga or the entire gas storage container Ga is exposed to the outside of the mass spectrometry device 1.

In this way, the gas storage container Ga is attached and detached after the gas storage container Ga is moved to a position where it is exposed to the outside, i.e., after the regulator 11*a* is moved to the non-measurement position P2. Positioning the regulator 11*a* at the non-measurement position P2 to attach and detach the gas storage container Ga makes attachment and detachment of the gas storage container Ga easier. For a threaded gas storage container Ga, in particular, the circumference of a part of the gas storage container Ga along its longitudinal axis, i.e., one end region of the gas storage container Ga is exposed to the outside of the mass spectrometry device 1 when the regulator 11*a* is positioned at the non-measurement position P2, as illustrated in FIG. 2B. An operator grips the exposed part of the gas storage container Ga and rotates the gas storage container Ga to attach and detach the gas storage container Ga to and from the regulator 11*a*. In other words, in the first embodiment, at least a part of the gas storage container Ga is exposed to the outside of the mass spectrometry device 1, so that it is possible to provide a wide work space for attaching and detaching the gas storage container Ga, thereby improving task efficiency.

With the mass spectrometry device according to the first embodiment described above, the following operational advantages can be achieved.

(1) The mass spectrometry device 1 according to the present embodiment includes the guide rails 13*a*, 13*b* as a movement mechanism for moving the holders 12*a*, 12*b* so that the regulators 11*a*, 11*b* move between the measurement position P1 and the non-measurement position P2. This enables the regulators 11*a*, 11*b* to be moved to the non-measurement position P2 for attachment and detachment of the gas storage containers Ga, Gb, which make the attachment and detachment easier. In other words, the task efficiency of the attachment and detachment of the gas storage containers Ga, Gb is improved.

(2) In the mass spectrometry device 1 according to the present embodiment, the measurement position P1 is an internal position where the gas storage containers Ga, Gb are not exposed to the outside of the mass spectrometry device 1, while the non-measurement position P2 is a position where the gas storage containers Ga, Gb are exposed to the outside. This allows an operational access to the externally exposed parts of the gas storage containers Ga, Gb, which makes the attachment and detachment of the gas storage containers Ga and Gb easier.

(3) In the mass spectrometry device 1 according to the present embodiment, the movement mechanism 13 includes the guide rails 13*a*, 13*b* that hold the holders 12*a*, 12*b* so that the holders 12*a*, 12*b* can move between the measurement position P1 and the non-measurement position P2. The gas storage containers Ga, Gb can thus be moved along the guide rails 13*a*, 13*b* which are designed as appropreate.

(4) In the mass spectrometry device 1 according to the present embodiment, the guide rails 13*a* and 13*b* hold the holders 12*a*, 12*b* so that the holders 12*a*, 12*b* can linearly move between the measurement position P1 and the non-measurement position P2. The gas storage containers Ga, Gb can thus be moved with a convenient operation.

(5) In the mass spectrometry device 1 according to the present embodiment, the movement mechanism 13 is configured to individually move the plurality of holders 12*a*, 12*b*. In the first embodiment, the guide rails 13*a*, 13*b* are provided individually for the plurality of gas storage containers Ga, Gb. It is thus possible to easily attach and detach one of the gas storage containers Ga, Gb, for example, even in a case where the other gas storage container Ga, Gb cannot be moved for some reason.

(6) The mass spectrometry device 1 according to the present embodiment includes a mass spectrometer, and the gas introduction chamber 5 has an electrode that controls ions. In this way, this embodiment can be applied to portable mass spectrometry devices, for example. The mass spectrometry device as in the first embodiment can have smaller size and weight, compared with other mass spectrometry devices. This can make the above effects (1) to (5) and other effects more suitable, since the mass spectrometry device is advantageously used with the gas storage containers Ga, Gb attached thereon in terms of portability and degrees of freedom of installation.

Second Embodiment

In the first embodiment, the storing unit 100 is configured so that the regulators 11*a*, 11*b* move between the measurement position P1 and the non-measurement position P2 by the holders 12*a*, 12*b* of the regulators 11*a*, 11*b* linearly moving on the guide rails 13*a*, 13*b*. The storing unit 100 may be configured so that the holders 12*a*, 12*b* can be pivoted to move the regulators 11*a*, 11*b* between the measurement position P1 and the non-measurement position P2. A storing unit of the mass spectrometry device 1A according to a second embodiment, which is designated by reference numeral 101, will be described hereinafter. Additionally, the regulators 11*a*, 11*b* are collectively designated by reference numeral 11, and the gas storage containers Ga, Gb are collectively designated by reference symbol G.

Figure 4A:
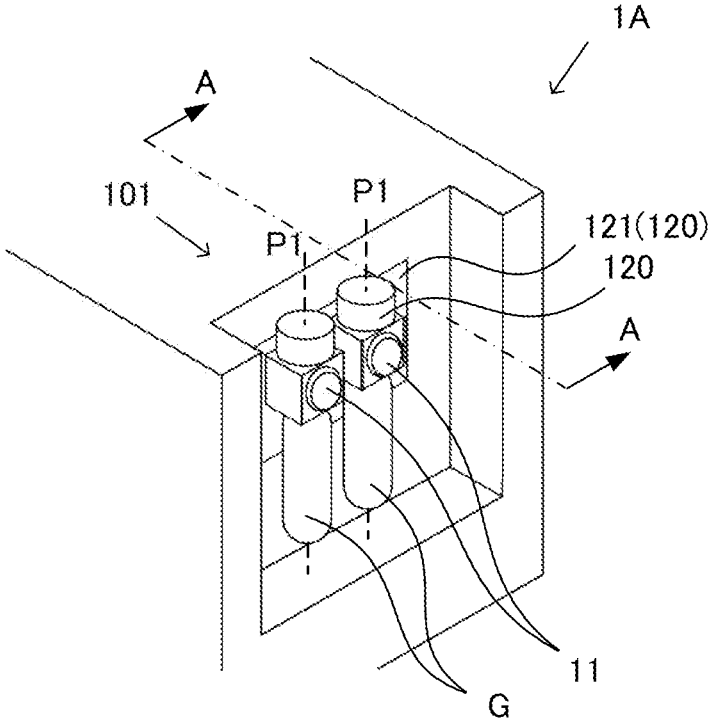
FIGS. 4A and 4B are perspective views illustrating a storing unit of a mass spectrometry device in a second embodiment.
Figure 4B:
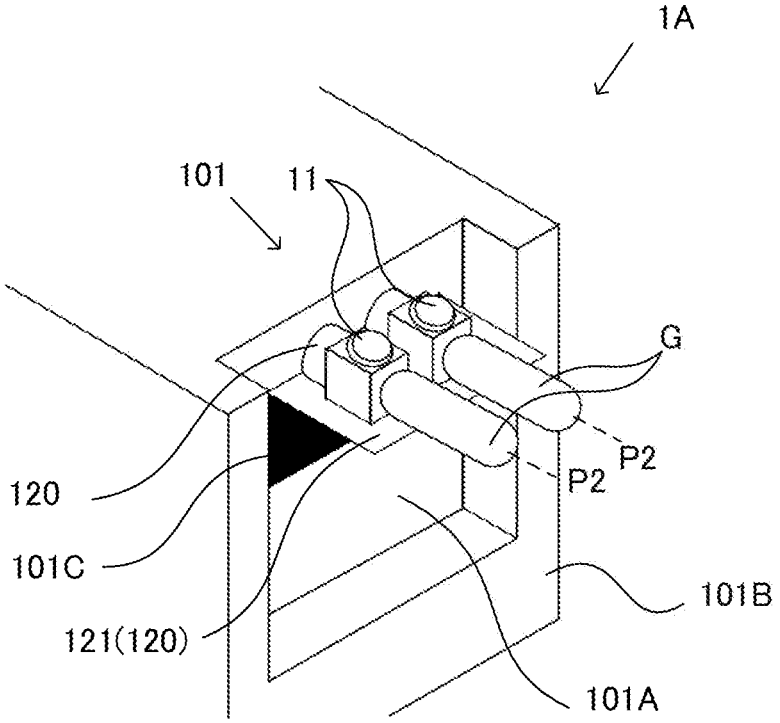

FIG. 4A is a perspective view illustrating a storing unit 101 in the case where the regulator 11 is positioned at the measurement position P1 and FIG. 4B is a perspective view illustrating the storing unit 101 in the case where the regulator 11 is positioned at the non-measurement position P2. The measurement position P1 and the non-measurement position P2 are schematically represented by longitudinal axes of the regulator 11 and the gas storage container G (see also FIGS. 5A and 5B). The regulator 11, to which the gas storage container G is attached, is held by a holder 120 that can be pivoted outward from the side surface of the mass spectrometry device 1A.

The storing unit 101 according to the second embodiment includes two regulators 11 to which two gas storage containers G are respectively attached, the holders 120 that hold the regulators 11, and a hinge mechanism 130 (see FIGS. 5A and 5B) which enables the holder 120 to be pivoted.

Figure 5A:
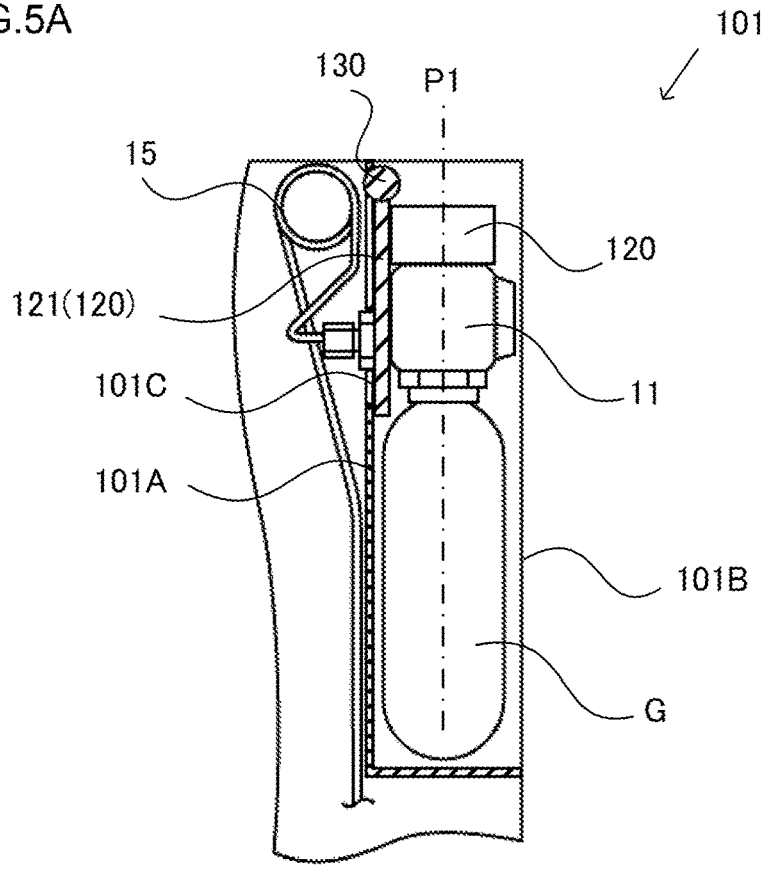
FIGS. 5A and 5B are cross-sectional views illustrating the storing unit of the mass spectrometry device in the second embodiment.

The storing unit 101 will be described in detail with reference to FIGS. 5A and 5B. FIG. 5A is a cross-sectional view taken along a line A-A in FIG. 4A. In the storing unit 101, the holder 120 is coupled to the hinge mechanism 130. When the hinge mechanism 130 rotates about an axis perpendicular to the plane of paper, the holder 120 is also rotated by the hinge mechanism 130.

The holder 120 has a flat-plate-like mount board 121, and the regulator 11 is mounted on one surface of the mount board 121. In FIG. 5A, the regulator 11 is provided with a gas introduction port in its lower end surface. The gas introduction port is, in turn, provided with an internal thread so that the gas storage container G is screwed into the introduction port. A through hole (not illustrated in the figure) serving as a gas passage is formed in the mount board 121, and a gas discharge port of the regulator 11 is connected to the through hole in a sealed state. A gas supply line 15 is connected to the through hole of the mount board 121 connected to the gas discharge port. The gas supply line 15 is individually provided for each gas storage container.

Gas stored in the gas storage container G is introduced into the gas supply line 15 through the regulator 11 and the holder 120 so that the gas can be supplied to the gas introduction chamber 5 (FIG. 1). The gas supply line 15 can be a tube made of metal or resin. In the case where the gas supply line 15 is made of metal, it is preferable that the metal tube constituting the gas supply line 15 is wound several times as illustrated in FIGS. 5A and 5B since its flexibility can thereby be enhanced. Although the gas supply line 15 is a metal tube, the gas supply line 15 does not prevent the pivot movement of the regulator 11.

Figure 5B:
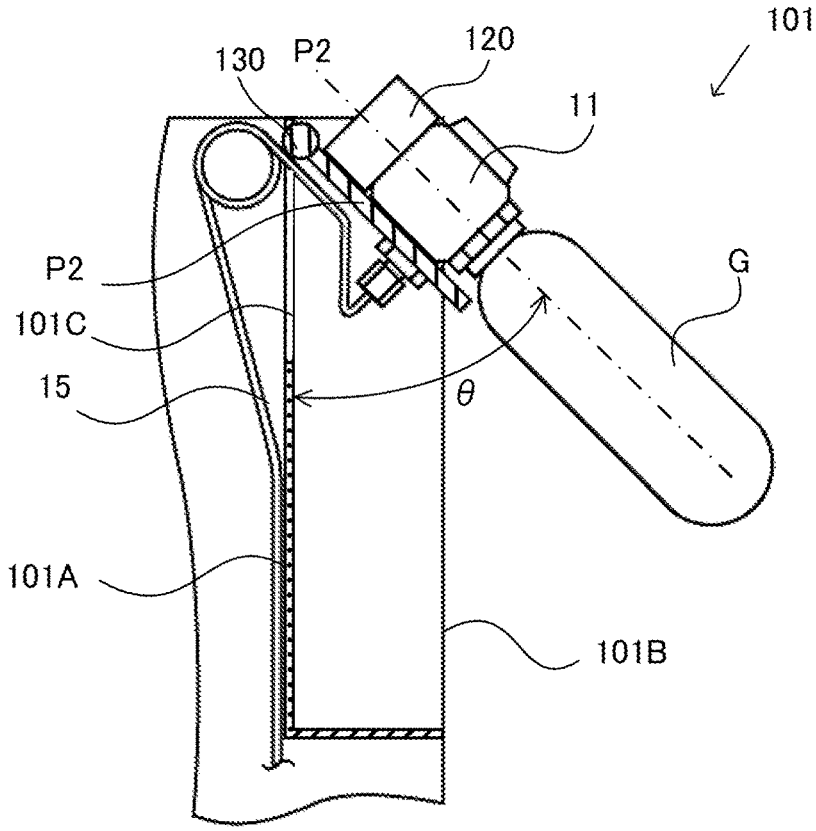

FIG. 5B illustrates a state where the holder 120 has been pivoted by the hinge mechanism 130 so that the regulator 11 has arrived at the non-measurement position P2. FIG. 5B is a cross-sectional view taken along the same line as in FIG. 5A. The rotation caused by the hinge mechanism 130 allows the holder 120, the regulator 11, and the gas storage container G to pivot to be inclined at an angle of θ with respect to the vertical direction of the apparatus (i.e. the vertical direction in the figure). This inclination is locked by a lock mechanism (not illustrated in the figure) in the process of pivoting the regulator 11 from the measurement position P1 to the non-measurement position P2. Inversely, in the process of pivoting the regulator 11 from the non-measurement position P2 to the measurement position P1, the lock by the lock mechanism (not illustrated in the figure) is released. The rotation angle θ made by the hinge mechanism 130 in a case where the regulator 11 is positioned at the non-measurement position P2 is not limited to a particular value and can be appropriately set in a range of 10 to 170 degrees, for example.

When the regulator 11 is positioned at the measurement position P1, the holder 120 constitutes a part of a side surface 101A of the mass spectrometry device 1A, and the regulator 11 is located close to the surface 101A of the mass spectrometry device 1A. At this time, the gas storage container G is arranged along the side surface 101A of the mass spectrometry device 1A.

When the regulator 11 is positioned at the non-measurement position P2, an end of the gas storage container G opposite to the regulator 11 is located further away from the surface of the mass spectrometry device 1A, compared with the case where the regulator 11 is positioned at the measurement position P1. In other words, the regulator 11 is located away from the side surface 101A. In the case where the regulator 11 is positioned at the non-measurement position P2, there is a larger space around the gas storage container G, compared with the case where the regulator 11 is positioned at the measurement position P1. This makes the attachment and detachment of the gas storage container G easier.

Specifically, the mass spectrometry device 1A has a space in which the storing unit 101 is to be set, as illustrated in FIG. 5A. The side surface 101A is a wall formed inside a housing 101B of the mass spectrometry device 1A. The hinge mechanism 130 described above is provided on an upper end of the wall 101A. The wall 101A has an opening 101C so as not to obstruct the movement of the gas supply line 15 along with the pivot movement of the holder 120 caused by the hinge mechanism 130. The mount board 121 is configured so as to close the opening 101C of the wall 101A when the regulator 11 is positioned at the measurement position.

When the regulator 11 is positioned at the measurement position P1 illustrated in FIG. 5A, the opening 101C is closed by the mount board 121. The gas supply line 15 is located on the inside of the wall 101A. When the regulator 11 is positioned at the non-measurement position P2 illustrated in FIG. 5B, the opening 101C is open since the mount board 121 pivots. The gas supply line 15 has moved through the opening 101A, i.e., through the wall 101A to the space side. In other words, the gas supply line 15 is located on the outside of the wall 101A.

In the mass spectrometry device 1A according to the second embodiment, the regulator 11 is provided at a position of the wall surface close to the side surface 101A of the housing 101B of the mass spectrometry device 1A when the regulator 11 is positioned at the measurement position P1. When the regulator 11 is positioned at the non-measurement position P2, at least one end of the gas storage container G is positioned at a position further away from the surface of the side surface 101A, compared with the measurement position P1. Since there is thus a space between the outer surface of the side surface 101A of the mass spectrometry device 1A and the one end of the gas storage container G, it is possible to provide a space enough to attach and detach the gas storage container G, which achieves an easy attachment and detachment of the gas storage container G.

When the regulator 11 is positioned at the measurement position P1, the distance between the side surface 101A of the housing 101B and the regulator 11 is preferably 5 cm or less, and more preferably 2 cm or less.

The mass spectrometry device 1A according to the second embodiment is provided with a hinge mechanism 130 that holds the holder 120 so that the holder 120 can pivot between the measurement position P1 and the non-measurement position P2, and the hinge mechanism 130 constitutes a pivot mechanism, i.e., a movement mechanism. Also in the mass spectrometry device 1A according to the second embodiment, the gas storage container G can be moved by the movement mechanism 13 with a convenient operation.

The following variation is also contemplated within the scope of the present invention and may be combined with the above embodiments. In the following variation, parts having the same structures and functions as those in the above embodiments will be designated by the same reference numerals, and description thereof will be appropriately omitted.

First Variation

By holding the hinge mechanism 130 in the second embodiment described above so that the hinge mechanism 130 can move along the guide rail 13, the regulator 11 can move between the measurement position P1 and the non-measurement position P2 in combination with the movement along the guide rail 13 and the pivot caused by the hinge mechanism 130.

In the mass spectrometry device according to this variation, a movement mechanism includes the guide rails 13 and the hinge mechanism 130, and the movement of the hinge mechanism 130 held by the guide rails 13 and the pivot movement of the holders 12 (120) held by the hinge mechanism 130 allow the regulators 11 to move between the measurement position P1 and the non-measurement position P2. The regulator 11 can thus be moved from the measurement position P1 to different non-measurement positions P2.

The present invention can also be applied to any types of analytical devices without particular limitation, such as analytical devices including no mass spectrometer as long as the analytical devices are attached to gas storage containers.

The present invention is not limited to the above embodiments. Other aspects contemplated within the technical idea of the present invention are also included within the scope of the present invention.

What is claimed is:

1. An analytical device comprising:

a regulator held by a holder and attached to a gas storage container;

a gas introduction chamber to which gas in the gas storage container is supplied through the regulator; and a movement mechanism that moves the holder so that the regulator moves with the gas storage container between a measurement position and a non-measurement position.

2. The analytical device according to claim 1, wherein:

the measurement position is a position of a regulator in which the gas storage container is located inside the analytical device; and the non-measurement position is a position of a regulator in which at least a part of the gas storage container or the entire gas storage container is exposed to an outside of the analytical device.

3. The analytical device according to a claim 2, wherein:

the movement mechanism comprises a guide rail that holds the holder so that the holder can move between the measurement position and the non-measurement position.

4. The analytical device according to claim 3, wherein:

the guide rail holds the holder so that the holder can linearly move between the measurement position and the non-measurement position.

5. The analytical device according to claim 2, wherein:

the movement mechanism comprises a hinge mechanism that holds the holder so that the holder can pivot between the measurement position and the non-measurement position.

6. The analytical device according to claim 2, wherein:

the movement mechanism comprises a guide rail and a hinge mechanism; and the movement of the hinge mechanism held by the guide rail and the pivot movement of the holder held by the hinge mechanism allow the regulator to move between the measurement position and the non-measurement position.

7. The analytical device according to claim 1, wherein:

the measurement position is a position in which the regulator is located close to a surface of a housing of the analytical device; and the non-measurement position is a position in which at least one end of the gas storage container is located further away from the surface of the housing, compared with when the regulator is positioned at the measurement position.

8. The analytical device according to a claim 7, wherein:

the movement mechanism comprises a guide rail that holds the holder so that the holder can move between the measurement position and the non-measurement position.

9. The analytical device according to claim 8, wherein:

the guide rail holds the holder so that the holder can linearly move between the measurement position and the non-measurement position.

10. The analytical device according to claim 7, wherein:

the movement mechanism comprises a hinge mechanism that holds the holder so that the holder can pivot between the measurement position and the non-measurement position.

11. The analytical device according to claim 7, wherein:

the movement mechanism comprises a guide rail and a hinge mechanism; and the movement of the hinge mechanism held by the guide rail and the pivot movement of the holder held by the hinge mechanism allow the regulator to move between the measurement position and the non-measurement position.

12. The analytical device according to claim 1, wherein:

the movement mechanism comprises a guide rail that holds the holder so that the holder can move between the measurement position and the non-measurement position.

13. The analytical device according to claim 12, wherein:

the guide rail holds the holder so that the holder can linearly move between the measurement position and the non-measurement position.

14. The analytical device according to claim 1, wherein:

the movement mechanism comprises a hinge mechanism that holds the holder so that the holder can pivot between the measurement position and the non-measurement position.

15. The analytical device according to claim 1, wherein:

the movement mechanism comprises a guide rail and a hinge mechanism; and the movement of the hinge mechanism held by the guide rail and the pivot movement of the holder held by the hinge mechanism allow the regulator to move between the measurement position and the non-measurement position.

16. The analytical device according to claim 1, comprising:

a plurality of regulators to which a plurality of gas storage containers are respectively attached and which are respectively held by the plurality of holders, wherein:

the movement mechanism individually moves the plurality of holders.

17. The analytical device according to claim 1, comprising:

a mass spectrometer, wherein:

the gas introduction chamber comprises an electrode that controls ions.

* * * * *